US008016034B2

(12) United States Patent
Glasbergen et al.

(10) Patent No.: US 8,016,034 B2
(45) Date of Patent: Sep. 13, 2011

(54) METHODS OF FLUID PLACEMENT AND DIVERSION IN SUBTERRANEAN FORMATIONS

(75) Inventors: Gerard Glasbergen, Gouda (NL); Thomas D. Weiton, Duncan, OK (US); Danial Gualtien, Spring, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 239 days.

(21) Appl. No.: 12/551,713

(22) Filed: Sep. 1, 2009

(65) Prior Publication Data

US 2011/0048708 A1 Mar. 3, 2011

(51) Int. Cl.

| | |
|---|---|
| ***E21B 33/138*** | (2006.01) |
| ***E21B 43/14*** | (2006.01) |
| ***E21B 43/26*** | (2006.01) |
| ***E21B 47/06*** | (2006.01) |
| ***E21B 47/09*** | (2006.01) |

(52) U.S. Cl. ..... 166/250.01; 166/281; 166/282; 166/283; 166/305.1; 166/308.1; 166/400

(58) Field of Classification Search ..... None
See application file for complete search history.

(56) References Cited

U.S. PATENT DOCUMENTS

| | | | | |
|---|---|---|---|---|
| 3,724,549 | A * | 4/1973 | Dill | 166/282 |
| 3,998,272 | A * | 12/1976 | Maly | 166/281 |
| 4,157,116 | A | 6/1979 | Coulter | |
| 4,261,421 | A | 4/1981 | Watanabe | |
| 4,527,628 | A * | 7/1985 | Dill et al. | 166/295 |
| 5,028,146 | A | 7/1991 | Wada | |
| 6,367,548 | B1 | 4/2002 | Purvis et al. | |
| 6,557,630 | B2 | 5/2003 | Harkins et al. | |
| 6,751,556 | B2 | 6/2004 | Schroeder et al. | |
| 6,896,058 | B2 | 5/2005 | Munoz, Jr. et al. | |
| 6,983,798 | B2 | 1/2006 | Todd | |
| 7,036,587 | B2 | 5/2006 | Munoz, Jr. et al. | |
| 7,055,604 | B2 | 6/2006 | Jee et al. | |
| 7,086,484 | B2 | 8/2006 | Smith, Jr. | |

(Continued)

FOREIGN PATENT DOCUMENTS

WO WO 2011/027100 A2 3/2011

OTHER PUBLICATIONS

International Search Report and Written Opinion for PCT/GB2010/001628 dated May 11, 2011.

(Continued)

*Primary Examiner* — George Suchfield
(74) *Attorney, Agent, or Firm* — Robert A. Kent; McDermott Will & Emery LLP

(57) ABSTRACT

Improved methods of placing and/or diverting treatment fluids in subterranean formations are provided. In one embodiment, the methods comprise: introducing a diverting material into a subterranean formation penetrated by a well bore to reduce or prevent the flow of fluid into a first portion of the subterranean formation; introducing a first fluid into a second portion of the subterranean formation having a higher fluid flow resistance than the first portion of the subterranean formation; allowing the diverting material to be removed from the subterranean formation after at least a portion of the first fluid has been introduced into the second portion of the subterranean formation; and introducing a second fluid into the first portion of the subterranean formation.

20 Claims, 4 Drawing Sheets

U.S. PATENT DOCUMENTS

| | | | | |
|---|---|---|---|---|
| 2006/0175059 | A1* | 8/2006 | Sinclair et al. | 166/283 |
| 2006/0276345 | A1 | 12/2006 | Todd et al. | |
| 2007/0169935 | A1 | 7/2007 | Akbar et al. | |
| 2010/0212906 | A1* | 8/2010 | Fulton et al. | 166/308.5 |
| 2011/0005761 | A1 | 1/2011 | Luo et al. | |

OTHER PUBLICATIONS

Glasbergen et al.; Real-Time Diversion Quantification and Optimization Using DTS; Society of Petroleum Engineers; 2007 SPE Annual Technical Conference and Exhibition; Anaheim, CA Nov. 11-14, 2007; SPE 110707.

Crowe, C.W.; Evaluation of Oil Soluble Resin Mixtures as Diverting Agents for Matrix Acidizing; 46th Annual Fall Meeting of the Society of Petroleum Engineers of AIME; New Orleans, LA Oct. 3-6, 1971, SPE 3505.

Glasbergen et al.; Design and Field Testing of a Truly Novel Diverting Agent; 2006 SPE Annual Technical Conference and Exhibition; San Antonio, Texas; Sep. 24-27, 2006; SP 102606.

Halliburton brochure entitled Stimulation; Guidon AGSsm Service, Revolutionary Diverter Technology Helps Achieve Optimum Results from Acidizing Treatments; Sep. 2005.

Halliburton brochure entitled Conformance; OSR-100™ Fluid-Loss Additive; Dec. 2007.

Halliburton brochure; Baroid Fluid Services; BARABARB® Bridging Agent, Product Data Sheet; 2006.

Halliburton brochure; Stimulation, BioVert™ H150 Diverter and Fluid Loss Control Material; Jul. 2008.

Halliburton brochure; Conformance, Matriseal® O Diverting Agent; Dec. 2007.

Halliburton brochure, Stimulation, US Land: Acid Stimulation Optimization; StimWatch® Stimulation Monitoring Service Powered by OptoLog® DTS Technology; 2008.

Gualtieri, Dan; The Application and Benefits of the StimWatch® Stimulation Monitoring Service; Drilling and Well Technology; Exploration & Production—Oil & Gas Review 2007.

Real-Time Fluid Tracking Optimizes Treatment Design, Improves Strategy; JPT, Oct. 2006.

U.S. Appl. No. 12/501,881, filed Jul. 13, 2009.

* cited by examiner

METHODS OF FLUID PLACEMENT AND DIVERSION IN SUBTERRANEAN FORMATIONS

BACKGROUND

The present invention relates to methods that may be useful in treating subterranean formations, and more specifically, to improved methods of placing and/or diverting treatment fluids in subterranean formations.

Treatment fluids may be used in a variety of subterranean treatments. As used herein, the term "treatment," or "treating," refers to any subterranean operation that uses a fluid in conjunction with a desired function and/or for a desired purpose. The terms "treatment," and "treating," as used herein, do not imply any particular action by the fluid or any particular component thereof. Examples of common subterranean treatments include, but are not limited to, drilling operations, pre-pad treatments, fracturing operations, perforation operations, preflush treatments, afterflush treatments, sand control treatments (e.g., gravel packing), acidizing treatments (e.g., matrix acidizing or fracture acidizing), "frac-pack" treatments, cementing treatments, water control treatments, fluid loss control treatments (e.g., gel pills), and well bore clean-out treatments.

In subterranean treatments, it is often desired to treat an interval of a subterranean formation having sections of varying permeability, porosity, damage, and/or reservoir pressures, and thus may accept varying amounts of certain treatment fluids. For example, low reservoir pressure in certain areas of a subterranean formation or a rock matrix or proppant pack of high porosity may permit that portion to accept larger amounts of certain treatment fluids. It may be difficult to obtain a uniform distribution of the treatment fluid throughout the entire interval. For instance, the treatment fluid may preferentially enter portions of the interval with low fluid flow resistance at the expense of portions of the interval with higher fluid flow resistance. In some instances, these intervals with variable flow resistance may be water-producing intervals. In other instances, the portion of an interval with low fluid flow resistance may be an elbow or turn in a well bore, into which the treatment fluid may preferentially enter. In yet other instances, the portion of an interval with low fluid flow resistance may be a junction of a multi-lateral well, into which the treatment fluid may preferentially enter.

In conventional methods of treating such subterranean formations, once the less fluid flow-resistant portions of a subterranean formation have been treated, that area may be sealed off using variety of techniques to divert treatment fluids to more fluid flow-resistant portions of the interval. Such techniques may have involved, among other things, the injection of particulates, foams, plugs, packers, or blocking polymers (e.g., crosslinked aqueous gels) into the interval so as to substantially plug off high-permeability portions of the subterranean formation once they have been treated, thereby diverting subsequently injected fluids to more fluid flow-resistant portions of the subterranean formation.

While these diversion techniques have been used successfully, there may be disadvantages. For example, in many cases, at least some portion of the diverting material may be placed in the more fluid flow-resistant portion of the subterranean formation inadvertently, which may hinder or prevent the complete treatment of that portion. Moreover, in instances where a less fluid flow-resistant portion of the formation has been fractured, certain types of diverting agents (e.g., particulates) may not be able to effectively seal off the area without using large volumes of the diverting agent, which may be costly to place and/or difficult to remove.

SUMMARY

The present invention relates to methods that may be useful in treating subterranean formations, and more specifically, to improved methods of placing and/or diverting treatment fluids in subterranean formations.

In one embodiment, the methods of the present invention comprise: introducing a diverting material into a subterranean formation penetrated by a well bore to reduce or prevent the flow of fluid into a first portion of the subterranean formation; introducing a portion of a first fluid into a second portion of the subterranean formation having a higher fluid flow resistance than the first portion of the subterranean formation; allowing the diverting material to be removed from the subterranean formation after at least a portion of the first fluid has been introduced into the second portion of the subterranean formation; and introducing a portion of a second fluid into the first portion of the subterranean formation.

In another embodiment, the methods of the present invention comprise: introducing a diverting material into a subterranean formation penetrated by a well bore to reduce or prevent the flow of fluid into a first portion of the subterranean formation; introducing a portion of a first fluid into a second portion of the subterranean formation having a higher fluid flow resistance than the first portion of the subterranean formation; allowing the diverting material to be removed from the subterranean formation after at least a portion of the first fluid has been introduced into the second portion of the subterranean formation; and introducing a portion of a second fluid into the first portion of the subterranean formation at a rate sufficient to create or enhance one or more fractures in the first portion of the subterranean formation.

In another embodiment, the methods of the present invention comprise: (a) introducing a first diverting material into a subterranean formation penetrated by a well bore to reduce or prevent the flow of fluid into a first portion of the subterranean formation; (b) determining when the first diverting material has reduced or prevented the flow of fluid into a first portion of the subterranean formation; (c) introducing a portion of a first fluid into a second portion of the subterranean formation having a higher fluid flow resistance than the first portion of the subterranean formation; (d) introducing a second diverting material into a subterranean formation penetrated by a well bore to reduce or prevent the flow of fluid into the second portion of the subterranean formation; (e) introducing a portion of a second fluid into the first portion of the subterranean formation at a first flow rate; (f) allowing the first diverting material to be removed from the subterranean formation; (g) determining when the first diverting material has been at least partially removed from the subterranean formation by monitoring the temperature in that portion of the subterranean formation; and (h) introducing a second fluid into the first portion of the subterranean formation.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

Figure 1:
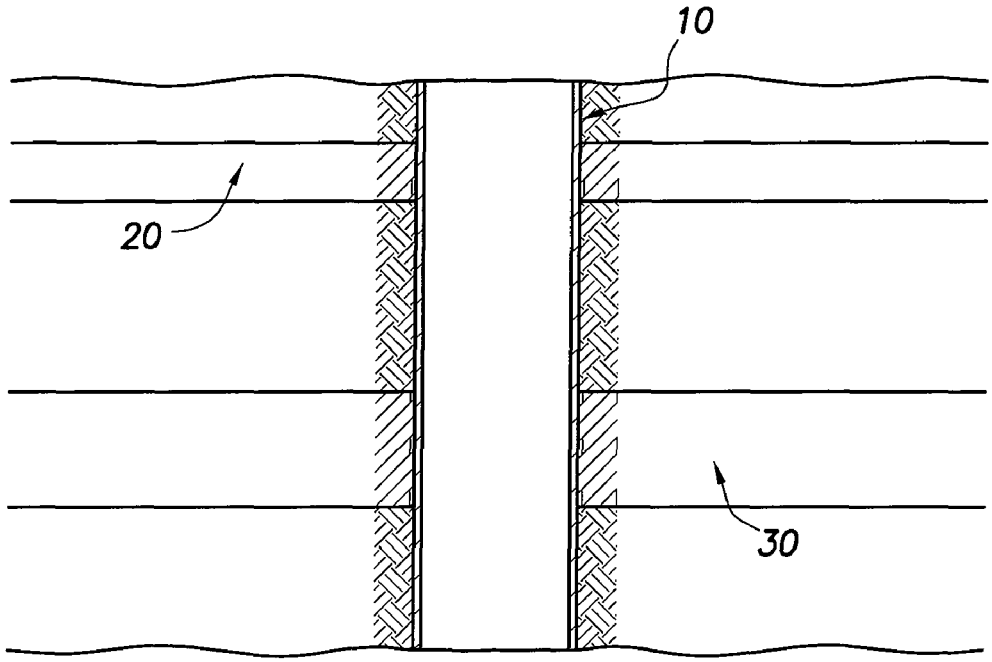
FIGS. 1-8 illustrate a series of steps performed in one embodiment of the methods of the present invention.

The present invention relates to methods that may be useful in treating subterranean formations, and more specifically, to improved methods of placing and/or diverting treatment fluids in subterranean formations.

The methods of the present invention generally comprise: introducing a diverting material into a subterranean formation penetrated by a well bore to reduce or prevent the flow of fluid into a first portion of the subterranean formation; introducing a first fluid into a second portion of the subterranean formation having a higher fluid flow resistance than the first portion of the subterranean formation; allowing the diverting material to be removed from the subterranean formation after at least a portion of the first fluid has been introduced into the second portion of the subterranean formation; and introducing a second fluid into the first portion of the subterranean formation. The term "diverting material," as used herein, means and refers generally to a material that functions to reduce or prevent, either temporarily or permanently, the flow of a fluid into a particular location, usually located in a subterranean formation, wherein the material serves to at least partially obstruct the location and thereby cause the fluid to "divert" to a different location. The term "fluid flow resistance" is used herein to refer to the diminishment of the rate at which fluid will flow into and/or through an area at a fixed rate of injection. As used herein, "fluid flow resistance" may result from low connective porosity of a portion of a formation, and/or the reduced ability of a portion of a formation to accept or transmit fluids, for example, due to higher reservoir pressure. For example, low reservoir pressure in certain areas of a subterranean formation or a rock matrix or proppant pack of high porosity may permit that portion of a formation to accept larger amounts of certain treatment fluids and thereby reduce its "fluid flow resistance." Another factor that may affect the "fluid flow resistance" of a portion of a subterranean formation may be low permeability in certain areas of a subterranean formation or rock matrix may permit that a portion of a formation or rock matrix to accept a larger amount of certain treatment fluids and thereby also reduce its "fluid flow resistance."

The methods of the present invention are generally used to treat subterranean formations having portions of differing fluid flow resistances. In some instances, these portions with variable fluid flow resistances may comprise water-producing intervals. In other instances, a portion of a subterranean formation with low fluid flow resistance may comprise an elbow or turn in a well bore into which the treatment fluid may preferentially enter. In yet other embodiments, the portion of a subterranean formation with low fluid flow resistance may be a junction of a multi-lateral well bore into which the treatment fluid may preferentially enter. Among the many advantages of the present invention, some of which are not alluded to herein, in certain embodiments, the methods of the present invention may facilitate improved control over the placement of treatment fluids in a subterranean formation, increased fluid efficiency in various subterranean treatments, and/or more complete treatment of fluid flow-resistant portions of a subterranean formation.

The subterranean formations treated in the methods of the present invention may be any subterranean formation having at least two portions of differing fluid flow resistances. At least a portion of the subterranean formation generally is penetrated by one or more well bores drilled in any direction through the formation. In certain embodiments, all or part of a well bore penetrating the subterranean formation may include casing pipes or strings placed in the well bore (a "cased hole" or a "partially cased hole"), among other purposes, to facilitate production of fluids out of the formation and through the well bore to the surface. In other embodiments, the well bore may be an "open hole" that has no casing. In those embodiments where the well bore is a cased or a partially cased hole, it may be necessary to create perforations in the casing string prior to or during a method of the present invention, inter alia, to permit fluid communication between the interior of the casing and the adjacent portion of the subterranean formation. These perforations may be made by any means or technique known in the art. In certain embodiments where a casing is perforated, it may be desirable to perforate the casing with a higher perforation density in the area adjacent to a portion or portions of the subterranean formation having higher fluid fluid flow resistance, among other reasons, to increase the flow of fluid to that portion.

The diverting material(s) used in the present invention may comprise any material or combination of materials that functions to reduce or prevent, either temporarily or permanently, the flow of a fluid into a particular location in a subterranean formation, wherein the material serves to at least partially obstruct the location and thereby cause the fluid to "divert" to a different location. Examples of materials that may be suitable for use as a diverting material in the present invention include, but are not limited to, fluids (e.g., aqueous-base and/or non-aqueous-base fluids), emulsions, gels (including but not limited to viscoelastic surfactant gels), surfactants (e.g., soaps or viscoelastic surfactants), foams, particulate materials (e.g., calcium carbonate, silica flour), certain polymers, relative permeability modifiers, degradable materials (e.g., polyesters, orthoesters, poly(orthoesters), polyanhydrides, polylactic acid, dehydrated organic or inorganic compounds, anhydrous borate, salts of organic acids, or any derivative thereof), resins (e.g., water soluble resins, oil soluble resins, etc.), balls, packers (e.g., pinpoint packers and selective injection packers), ball sealers, pack-off devices, sand plugs, bridge plugs, and the like. "Degradable materials" include those materials that are capable of undergoing an irreversible degradation downhole. The term "irreversible," as used herein, means that the degradable diverting agent, once degraded, should not recrystallize or reconsolidate while downhole, e.g., the degradable diverting agent should degrade in situ but should not recrystallize or reconsolidate in situ. The terms "degradation" or "degradable" refer to both the two relatively extreme cases of hydrolytic degradation that the degradable diverting agent may undergo, e.g., bulk erosion and surface erosion, and any stage of degradation in between these two. This degradation can be a result of, inter alia, a chemical or thermal reaction, or a reaction induced by radiation. The term "derivative" is defined herein to include any compound that is made from one of the listed compounds, for example, by replacing one atom in the listed compound with another atom or group of atoms, rearranging two or more atoms in the listed compound, ionizing the listed compounds, or creating a salt of the listed compound. Examples of commercially-available materials that may be suitable diverting materials in the methods of the present invention include those products available under the tradenames GUIDON$^{SM}$ AGS, BIOVERT™, BARACARB®, OSR 100™, and MATRISEAL®, all available from Halliburton Energy Services of Duncan, Okla. Other examples of diverting materials that may be suitable for use in the methods of the present invention also may include those described in U.S. Pat. Nos.

6,983,798 and 6,896,058 and U.S. patent application Ser. No. 12/501,881 (filed on Jul. 13, 2009), the entireties of which are herein incorporated by reference.

The choice of a diverting material, including the desired size and shape of any particulate diverting material, in the methods of the present invention may depend on, among other factors, the type of subterranean formation (e.g., rock characteristics), the presence or absence of a casing in the subterranean formation, the composition of the treatment fluid(s) to be used, the temperature of the subterranean formation, the size of the perforations, the desired timing and rate for its removal, and any subsequent treatments to be performed following the method of the present invention. For example, if the diverting material is to be placed in a portion of a well bore that is uncased, a diverting material should be chosen that it is capable of forming a filter cake on the inside wall of the well bore. In other embodiments, the particle size of a particulate diverting material may be selected such that the fluid permeability of those particulates in a pack is relatively low. A person of skill in the art will recognize suitable and/or preferred materials for the diverting materials for a particular application of the present invention with the benefit of this disclosure in view of these and other factors.

The diverting material used in the present invention (i.e., the diverting material used to reduce or prevent the flow of fluid into the less fluid flow-resistant portion of the subterranean formation) should be degradable, dissolvable, or otherwise removable by some means known in the art. In certain embodiments, this diverting material may be selected as a material that degrades or dissolves in the presence of the fluid used to treat the less fluid flow-resistant portion of the subterranean formation (or a component thereof) and/or an intermediate fluid introduced into the formation after the more fluid flow-resistant portion of the formation has been treated. In certain embodiments, the diverting material may be selected as a material that is simply removed over the passage of time.

In certain embodiments, a second diverting material optionally may be introduced into the subterranean formation, among other purposes, to reduce or prevent the flow of fluid into the more fluid flow-resistant portion of the subterranean formation after at least a portion of the first fluid has been introduced into that portion of the subterranean formation. In certain embodiments, the optional second diverting material may be chosen such that it will not substantially degrade, dissolve, or otherwise be removed by the fluid used to treat the less fluid flow-resistant portion of the subterranean formation, or will not substantially degrade, dissolve, or otherwise be removed by that fluid within a particular period of time allotted for treatment. However, such a second diverting material may be otherwise removable (e.g., removable after a long period of time) even though it is not removable under the conditions set forth above. For example, if an aqueous fluid is used to treat a less fluid flow-resistant portion of the subterranean formation, then it may not be desirable to use a second diverting material that degrades or dissolves in the presence of water, such as polylactic acid. A person of skill in the art with the benefit of this disclosure will recognize diverting materials appropriate for such uses depending on, among other things, the fluids being used, the time of treatment, conditions in the formation being treated, and other factors.

The first and second fluids used in the methods of the present invention may comprise any formation fluid or treatment fluid used or found in subterranean formations or treatments. As used herein, the term "treatment fluid" refers generally to any fluid that may be used in a subterranean application in conjunction with a desired function and/or for a desired purpose. The term "treatment fluid" does not imply any particular action by the fluid or any component thereof. These fluids may be used to perform one or more subterranean treatments or operations, which may include any subterranean treatment or operation known in the art. Examples of common subterranean treatments include, but are not limited to, drilling operations, pre-pad treatments, fracturing operations, perforation operations, preflush treatments, afterflush treatments, sand control treatments (e.g., gravel packing), acidizing treatments (e.g., matrix acidizing or fracture acidizing), "frac-pack" treatments, cementing treatments, water control treatments, and well bore clean-out treatments.

Depending on the type of treatment to be performed, the fluid may comprise any treatment fluid known in the art. Examples of treatment fluids that may be suitable include fracturing fluids, gravel packing fluids, pre-pad fluids, pad fluids, preflush fluids, afterflush fluids, acidic fluids, consolidation fluids, cementing fluids, well bore clean-out fluids, conformance fluids, aqueous fluids (e.g., fresh water, salt water, brines, etc.), non-aqueous fluids (e.g., mineral oils, synthetic oils, esters, etc.), hydrocarbon-based fluids (e.g., kerosene, xylene, toluene, diesel, oils, etc.), foamed fluids (e.g., a liquid that comprises a gas), gels, emulsions, gases, and the like. The fluids used in the present invention optionally may comprise one or more of any additives known in the art, provided that such additives do not interfere with other components of the fluid or other elements present during its use. Examples of such additional additives include, but are not limited to, salts, soaps, surfactants, co-surfactants, carboxylic acids, acids, fluid loss control additives, gas, foamers, corrosion inhibitors, scale inhibitors, crosslinking agents, catalysts, clay control agents, biocides, friction reducers, antifoam agents, bridging agents, dispersants, flocculants, $H_2S$ scavengers, oxygen scavengers, lubricants, viscosifiers, breakers, weighting agents, relative permeability modifiers, resins, particulate materials (e.g., proppant particulates), wetting agents, coating enhancement agents, and the like. A person skilled in the art, with the benefit of this disclosure, will recognize the types of additives that may be included in the fluids for a particular application.

In certain embodiments, the second fluid may be used not only to treat a less fluid flow-resistant portion of the subterranean formation, but it also may be used to remove at least a portion of the diverting material used to divert fluid while the more fluid flow-resistant portion(s) is treated. In embodiments where the second fluid is used in this manner, the second fluid may be introduced initially at a lower flow rate or with a short initial stage followed by a significant reduction of flow rate, among other things, to permit the second fluid to soak into the diverting material to facilitate its removal. In some embodiments, the well bore may be shut in for some period of time, among other purposes, to permit the diverting material to react with the second fluid and be removed. Once the diverting material has been at least partially removed, the flow rate of the second fluid may be increased to allow the fluid to penetrate into the less fluid flow-resistant portion of the formation.

To illustrate one embodiment of the methods of the present invention, the following example of one embodiment of the invention is explained with reference to FIGS. 1-8. In no way should the following example be read to limit, or define, the entire scope of the invention.

Figure 2:
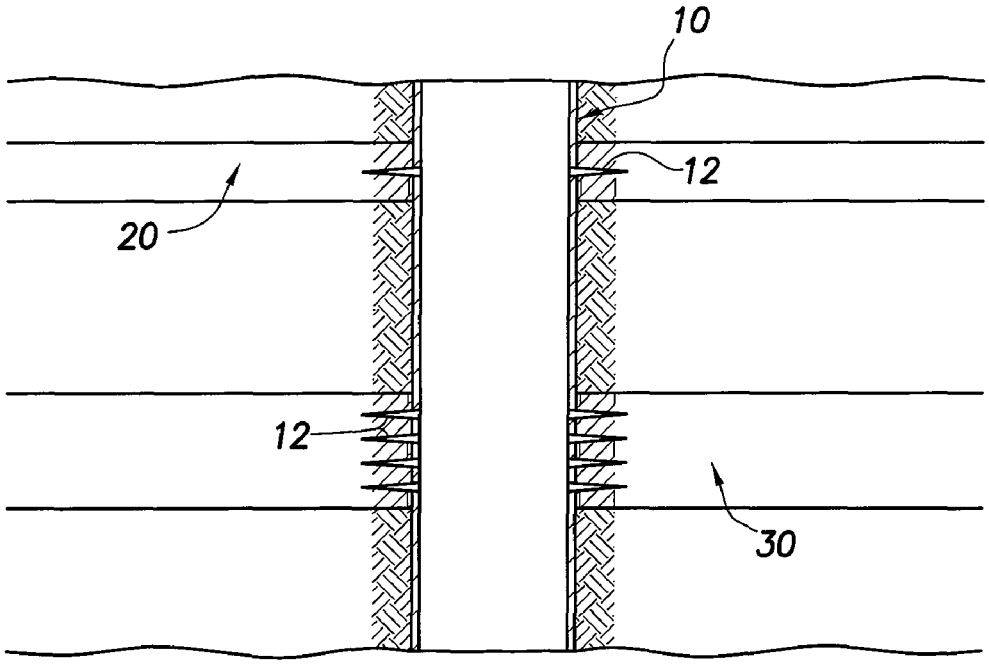
Figure 3:
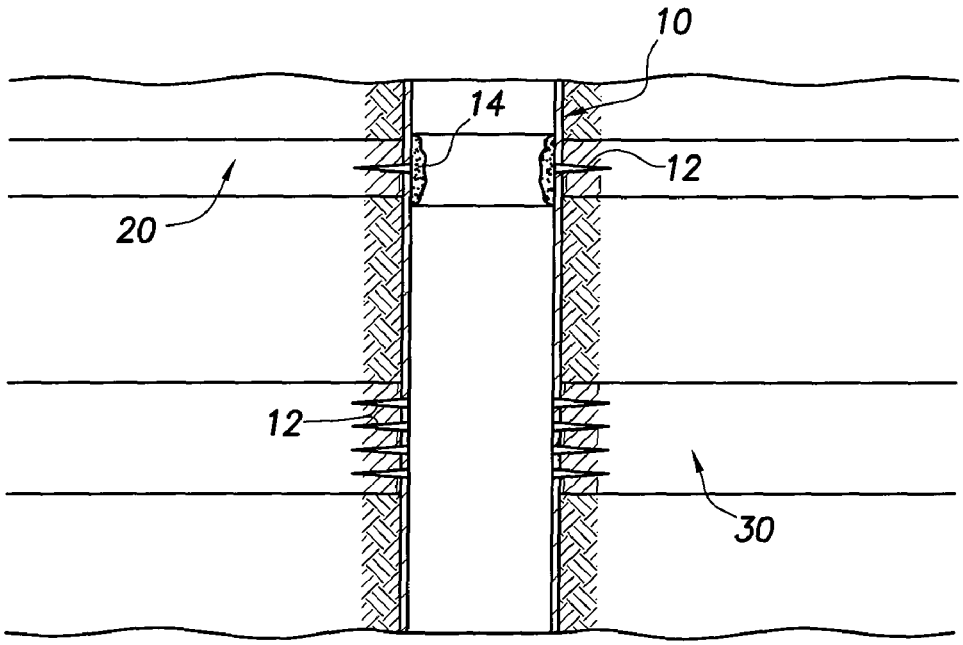
Figure 4:
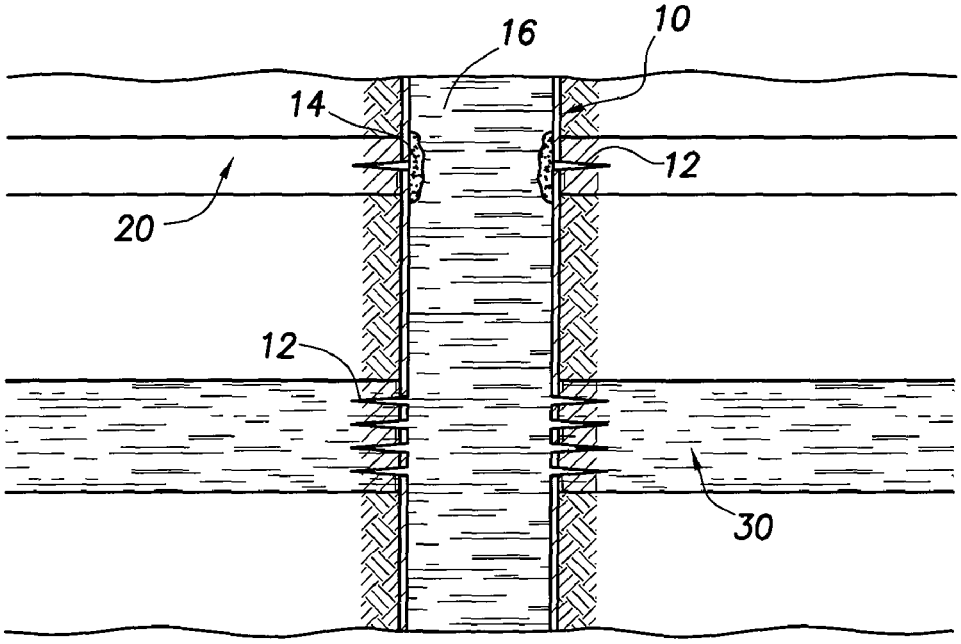
Figure 5:
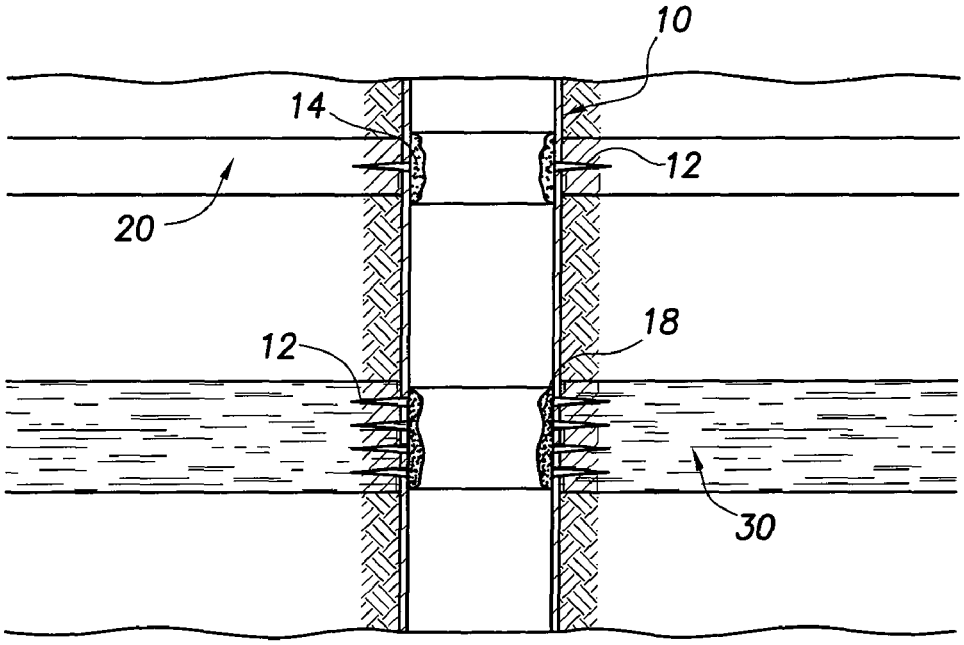
Figure 6:
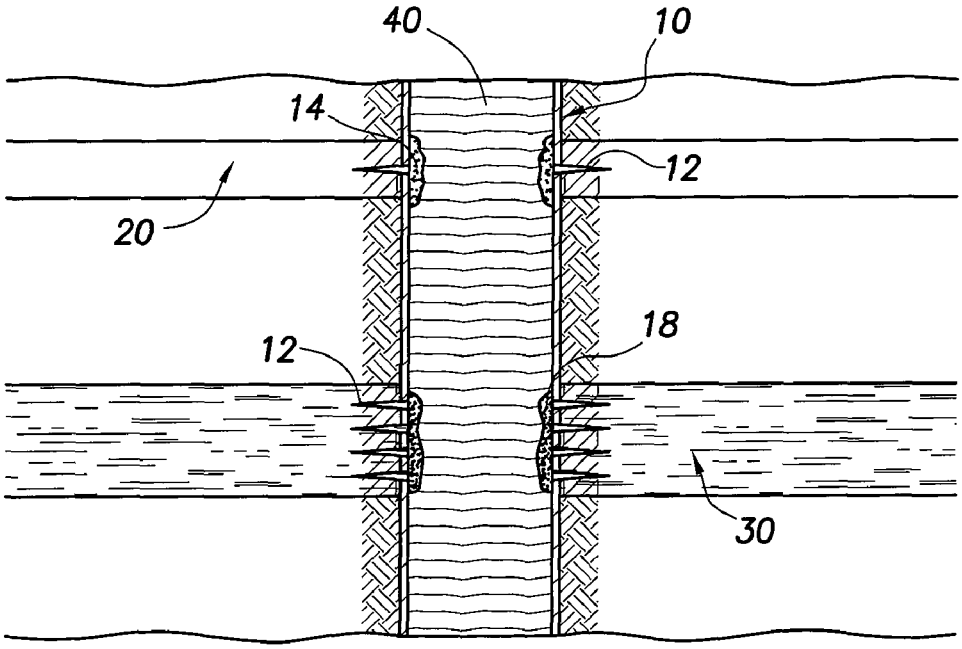
Figure 7:
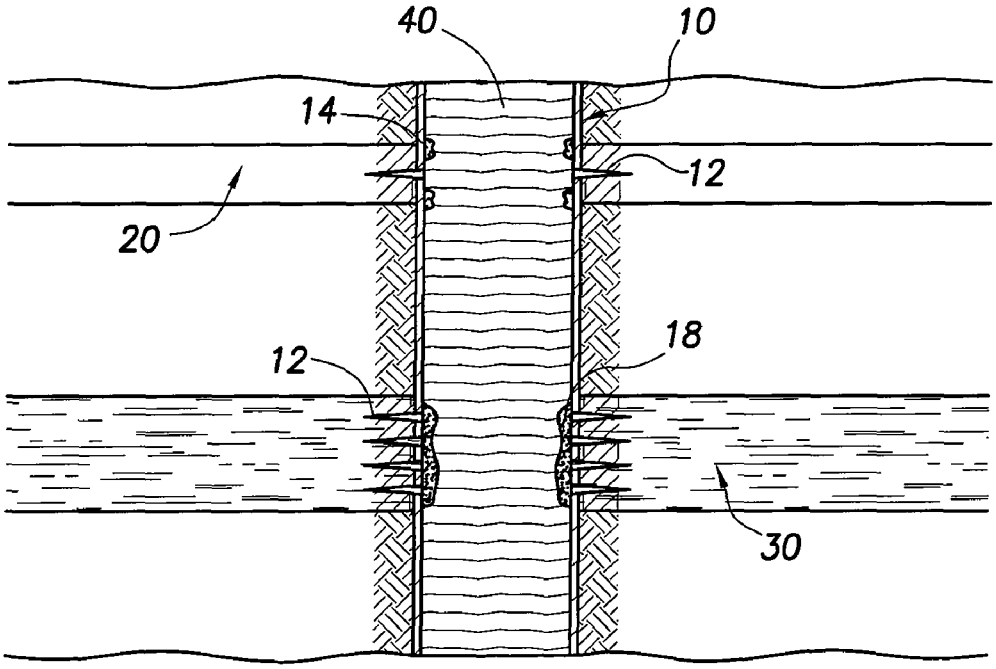
Figure 8:
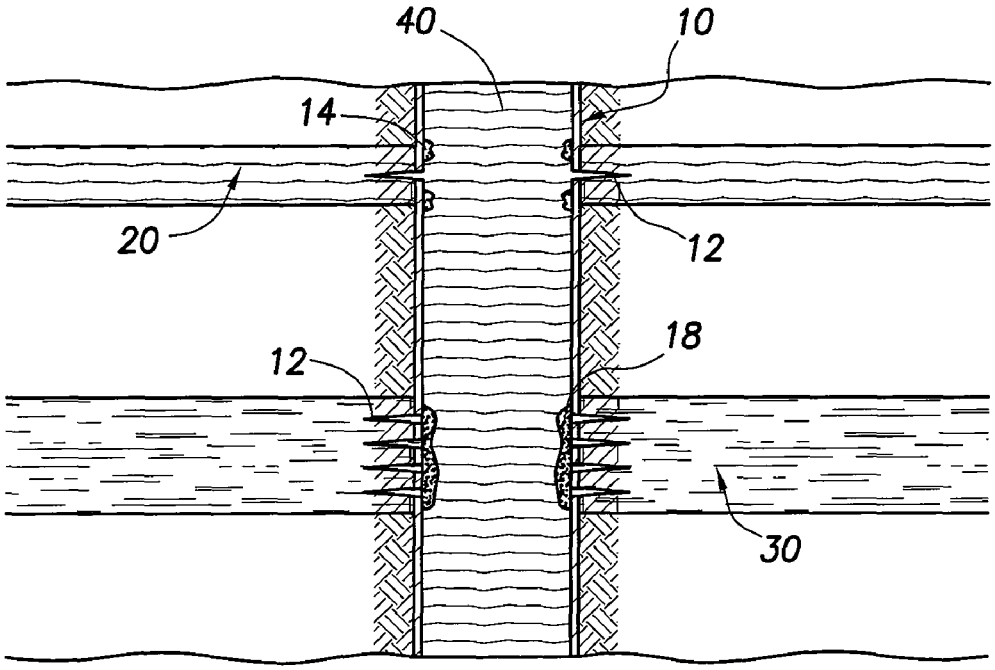

We first refer to FIG. 1, which shows a side view of subterranean formation penetrated by a well bore with a casing string 10 placed in the well bore. The well bore penetrates two zones 20 and 30 in the subterranean formation, wherein the fluid flow resistance of zone 30 is higher than the fluid flow resistance of zone 20. FIG. 2 shows perforations 12 created in the casing 10. In this embodiment, the portion of the casing adjacent to zone 30 has been perforated with a higher perforation density than zone 20. Turning to FIG. 3, a diverting material 14 is placed to obstruct zone 20 and divert fluid flowing into the well bore to other portions of the subterranean formation. Turning to FIG. 4, a treatment fluid 16 is introduced into zone 30, despite the higher fluid flow resistance of zone 30, because the diverting material 14 diverts the fluid away from zone 20. FIG. 5 shows the zone 30 fully treated by the treatment fluid 16, which may include treatments such as fracturing (i.e., introducing a fluid at a rate sufficient to create or enhance one or more fractures in the subterranean formation), acidizing, scale inhibitor treatment, and/or any other subterranean treatment known in the art. Once zone 30 has been sufficiently treated (which may be ascertained through any technique known in the art, a few of which are described below), a diverting material 18 may placed to obstruct now treated zone 30 and divert fluids in the well bore to other portions of the subterranean formation. FIG. 6 illustrates the next step in this embodiment where a treatment fluid 40 is introduced into the well bore and the injection rate is reduced to allow the fluid to sit in the well bore. In certain embodiments, this fluid may contact diverting material 18 without substantially dissolving, degrading, or otherwise removing diverting material 18. However, treatment fluid 40 may be formulated to dissolve, degrade, or otherwise remove most or all of diverting material 14, as shown in FIG. 7. Turning to FIG. 8, if the injection rate of treatement fluid 40 is increased, treatement fluid 40 is introduced into zone 20 (in certain embodiments, a fluid different from treatment fluid 40 may be introduced at this time instead). As shown, treatment fluid 40 is diverted away from zone 30 by diverting material 18, and zone 20 is then treated (e.g., fractured, acidized, etc.) by treatment fluid 40.

In certain embodiments, the methods of the present invention optionally may comprise introducing one or more spacer fluids before or after any of the other steps of the methods of the present invention, among other purposes, to isolate different fluids used to treat the formation at different times. These spacer fluids may comprise any fluid known in the art, such as aqueous fluids (e.g., fresh water, salt water, brines, etc.), non-aqueous fluids (e.g., mineral oils, synthetic oils, esters, etc.), hydrocarbon-based fluids (e.g., kerosene, xylene, toluene, diesel, oils, etc.), foamed fluids (e.g., a liquid that comprises a gas), gels, emulsions, gases, and the like. These optional spacer fluids may comprise one or more of any additional additives known in the art, provided that such additives do not interfere with other components of the fluid or other elements present during its use.

In certain embodiments, the methods of the present invention optionally may comprise monitoring the flow of one or more fluids (e.g., the first and/or second fluids) in at least a portion of the subterranean formation during all or part of a method of the present invention, for example, to ensure that the more fluid flow-resistant portions of the subterranean formation have been treated before a diverting material is removed, to determine the presence or absence of a first or second diverting material in the formation, and/or to determine whether a first and/or second diverting material actually diverts fluids introduced into the subterranean formation. This may be accomplished by any technique or combination of techniques known in the art. In certain embodiments, this may be accomplished by monitoring the fluid pressure at the surface of a well bore penetrating the subterranean formation where fluids are introduced. For example, if the fluid pressure at the surface increases, this may indicate that the fluid is being diverted to a more fluid flow-resistant portion of the subterranean formation. These techniques may include various logging techniques and/or computerized fluid tracking techniques known in the art that are capable of monitoring fluid flow. Examples of commercially available services involving surface fluid pressure sensing that may be suitable for use in the methods of the present invention include those available under the tradename EZ-GAUGE™ from Halliburton Energy Services of Duncan, Okla.

In certain embodiments, monitoring the flow of one or more fluids in at least a portion of the subterranean formation may be accomplished, in part, by using a distributed temperature sensing (DTS) technique. These techniques may involve a series of steps. Generally, a temperature sensing device (e.g., thermocouples, thermistors, or fiber optic cables) may be placed in a well bore penetrating a portion of a subterranean formation, either permanently or retrievably, to record temperature data in the formation and/or the well bore. In certain applications, a fiber optic cable may be pre-installed in a casing string before the casing string is placed in the well bore. In certain applications, it may be desirable to use an additional apparatus (e.g., coiled tubing) or fluid to place the fiber optic cable in the well bore. In certain embodiments, one may establish baseline temperature profile for all or part of the subterranean formation, and then monitor changes in temperature to determine the flow of fluids in various portions of the subterranean formation. Various computer software packages may be used to process the temperature data and/or create visualizations based on that data. Certain DTS techniques that may be suitable for use in the methods of the present invention may include commercially-available DTS services such as those known under the tradenames STIM-WATCH® (available from Halliburton Energy Services of Duncan, Okla.) or SENSA™ (available from Schlumberger Technology Corporation, Sugar Land, Tex.). Certain examples of DTS techniques that may be suitable for use in the methods of the present invention also may include those described in U.S. Pat. Nos. 7,055,604; 6,751,556; 7,086,484; 6,557,630; and 5,028,146, the entireties of which are herein incorporated by reference. A person of skill in the art with the benefit of this disclosure will recognize whether it is desirable to monitor the flow of one or more fluids in at least a portion of the subterranean formation as well as techniques of doing so appropriate for a particular application of the present invention based on, inter alia, the characteristics (e.g., fluid flow resistances) of various portions of the subterranean formation, the types of fluids present, equipment availability, and other relevant factors.

In certain embodiments, the methods of the present invention optionally may comprise monitoring the presence of a diverting material during all or part of a method of the present invention. This may be accomplished by any technique or combination of techniques known in the art. In certain embodiments, this may be accomplished by monitoring the temperature in a portion of the subterranean formation and/or well bore, for example, to determine whether a diverting material has been degraded or dissolved before the less fluid flow-resistant portion of the formation is treated. For example, the degradation and/or dissolution of certain diverting materials may comprise an exothermic reaction that gives off heat, and thus an increase in temperature may indicate that the diverting material is being or has been removed. Where this monitoring step is performed, it may be done using any means known in the art, including but not limited to the distributed temperature sensing techniques described above. In certain embodiments, the presence of a diverting material may be monitored by calculating the estimated time of its removal, for example, based on the reaction rate of a diverting material with a fluid that is introduced downhole to degrade or dissolve the material or to initiate its self-degradation. A person of skill in the art with the benefit of this disclosure will recognize whether it is desirable to monitor the presence of a diverting material as well as techniques of doing so appropriate for a particular application of the present invention based on, inter alia, the characteristics (e.g., fluid flow resistances) of various portions of the subterranean formation, the type of diverting material used, equipment availability, and other relevant factors.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method comprising:

introducing a diverting material into a subterranean formation penetrated by a well bore to reduce or prevent the flow of fluid into a first portion of the subterranean formation;

introducing a portion of a first fluid into a second portion of the subterranean formation having a higher fluid flow resistance than the first portion of the subterranean formation;

allowing the diverting material to be removed from the subterranean formation after at least a portion of the first fluid has been introduced into the second portion of the subterranean formation; and introducing a portion of a second fluid into the first portion of the subterranean formation.

2. The method of claim 1 further comprising the step of introducing a second diverting material into the subterranean formation to reduce or prevent the flow of fluid into a second portion of the subterranean formation after at least a portion of the first fluid has been introduced into the second portion of the subterranean formation.

3. The method of claim 2 wherein the second diverting material is not substantially degradable, dissolvable, or otherwise removable by the second fluid.

4. The method of claim 1 further comprising the step of monitoring the flow of the first fluid in the second portion of the subterranean formation.

5. The method of claim 4 wherein monitoring the flow of the first fluid in the second portion of the subterranean formation comprises using a distributed temperature sensing apparatus.

6. The method of claim 4 wherein monitoring the flow of the first fluid in the second portion of the subterranean formation comprises monitoring the fluid pressure at the surface of a well bore penetrating the subterranean formation.

7. The method of claim 1 further comprising the step of monitoring the presence of the diverting material in the subterranean formation.

8. The method of claim 1 wherein one or more casing strings are present in the well bore.

9. The method of claim 8 wherein one or more of the casing strings comprise a plurality of perforations in a portion of the casing string adjacent to the first and second portions of the subterranean formation.

10. The method of claim 9 wherein the perforation density in the portion of the casing string adjacent to the second portion of the subterranean formation is higher than the perforation density in the portion of the casing string adjacent to the first portion of the subterranean formation.

11. The method of claim 1 wherein the diverting material comprises at least one degradable material.

12. A method comprising:

introducing a diverting material into a subterranean formation penetrated by a well bore to reduce or prevent the flow of fluid into a first portion of the subterranean formation;

introducing a portion of a first fluid into a second portion of the subterranean formation having a higher fluid flow resistance than the first portion of the subterranean formation;

allowing the diverting material to be removed from the subterranean formation after at least a portion of the first fluid has been introduced into the second portion of the subterranean formation; and introducing a portion of a second fluid into the first portion of the subterranean formation at a rate sufficient to create or enhance one or more fractures in the first portion of the subterranean formation.

13. The method of claim 12 wherein the diverting material comprises at least one degradable material.

14. The method of claim 12 further comprising the step of introducing a second diverting material into the subterranean formation to reduce or prevent the flow of fluid into a second portion of the subterranean formation after at least a portion of the first fluid has been introduced into the second portion of the subterranean formation.

15. The method of claim 14 wherein the second diverting material is not substantially degradable, dissolvable, or otherwise removable by the second fluid.

16. The method of claim 12 further comprising the step of monitoring the flow of the first fluid in the second portion of the subterranean formation.

17. The method of claim 16 wherein monitoring the flow of the first fluid in the second portion of the subterranean formation comprises using a distributed temperature sensing apparatus.

18. A method comprising:

(a) introducing a first diverting material into a subterranean formation penetrated by a well bore to reduce or prevent the flow of fluid into a first portion of the subterranean formation;

(b) determining when the first diverting material has reduced or prevented the flow of fluid into a first portion of the subterranean formation;

(c) introducing a portion of a first fluid into a second portion of the subterranean formation having a higher fluid flow resistance than the first portion of the subterranean formation;

(d) introducing a second diverting material into a subterranean formation penetrated by a well bore to reduce or prevent the flow of fluid into the second portion of the subterranean formation;

(e) introducing a portion of a second fluid into the first portion of the subterranean formation at a first flow rate;

(f) allowing the first diverting material to be removed from the subterranean formation;

(g) determining when the first diverting material has been at least partially removed from the subterranean formation by monitoring the temperature in that portion of the subterranean formation; and (h) introducing a second fluid into the first portion of the subterranean formation.

19. The method of claim 18 wherein the first diverting material comprises at least one degradable material.

20. The method of claim 18 wherein step (b) or (g) comprises using a distributed temperature sensing apparatus.

* * * * *